United States Patent [19]

Kawai et al.

[11] Patent Number: 5,057,742

[45] Date of Patent: Oct. 15, 1991

[54] DISCHARGE TUBE

[75] Inventors: Koji Kawai; Yuji Shimazu; Koji Takeuchi, all of Shizuoka, Japan

[73] Assignee: Hamamatsu Photonics K.K., Shizuoka, Japan

[21] Appl. No.: 482,485

[22] Filed: Feb. 21, 1990

[30] Foreign Application Priority Data

Feb. 21, 1989 [JP] Japan ..... 1-41002

[51] Int. Cl.[5] ..... H01J 17/18; H01J 1/52; H01J 1/88

[52] U.S. Cl. ..... 313/623; 313/242; 313/292

[58] Field of Search ..... 313/623, 625, 239, 242, 313/243, 244, 284, 285, 290, 292

[56] References Cited

U.S. PATENT DOCUMENTS 2,396,170 3/1946 Fulton ..... 313/242 X
2,564,040 8/1951 Vance ..... 313/292 X
3,923,189 12/1975 Faulkner ..... 220/2.3 R
3,956,655 5/1976 Pevo ..... 313/112

OTHER PUBLICATIONS

Soviet Inventions Illustrated, EL Section, Week D21, Jul. 1, 1981, Derwent Publications Ltd., London X26, SU-756-520.

*Primary Examiner*—Sandra L. O'Shea
*Attorney, Agent, or Firm*—Finnegan, Henderson, Farabow, Garrett, and Dunner

[57] ABSTRACT

A discharge tube has a sealed envelope filled with a gas; an anode, cathode and shielding electrode built in the sealed envelope; and electrode holding pins. At least eight electrode holding pins penetrate a button stem so as to be arranged at predetermined intervals on a circle coaxial with the button stem, and, of at least eight electrode holding pins, at least three hold the cathode, at least three hold the shielding electrode, and at least two hold the anode.

5 Claims, 3 Drawing Sheets

DISCHARGE TUBE

BACKGROUND OF THE INVENTION

This invention relates to a discharge tube which is mainly used for various analyses or quantitative measurements.

One example of a discharge tube of this type is a deuterium lamp as shown in FIGS. 2(*a*) through 2(*c*). The lamp has first, second, third and fourth pins 1, 2, 3 and 4 to support electrodes. Those pins are arranged in a line at predetermined intervals in a relatively flat pinched stem 5 of glass. The fourth pin 4 supports a shielding electrode 6 directly. The third pin 3 supports an anode 7. The second pin holds the negative (−) side of a cathode 9 through a ceramic pipe 8, while the first pin 1 holds the positive (+) side of the cathode 9. The shielding electrode 6 has an electron converging part 11 including a small hole confronting the anode 7. The ceramic pipes 8 and 10 are fixedly secured to the shielding electrode 6 with bands 12. The ceramic pipe 10 is connected to the first pin 1. In FIG. 2, reference numeral 13 designates a sealed envelope of glass.

These electrode holding pins 1 through 4 generally have a diameter (*d*) in the range of:

$$0.8 < d < 1.2 \text{ mm.}$$

In this case, it is necessary that the distance $L_g$ between the junction of the fourth pin 4 and the shielding electrode 6 and the outer end of the pinched stem 5 is more than 12 mm, the minimum distance $L_a$ between the electron converging part 11 and the outer end of the stem 5 is more than 24 mm, and the distance $L_k$ curved along the pin from the electron emitting center of the cathode 9 to the outer end of the stem 5 is more than 28 mm; otherwise heat generated in the lamp when turned on (such as heat generated by the impact of hydrogen ions on the hot-cathode surface, heat generated in the surface of the electron converging part 11 by the emission of light at the electron converging part 11, and heat generated when electrons strike the anode 7) would cause thermal adverse effects on the glass system of the lamp. In the pinched stem 5, the glass and the metal material (of the electrode holding pins) are fused with each other which are different in thermal expansion coefficient from each other. Therefore, for instance when the lamp input is 30 W, if the above-described conditions $L_g > 12$ mm, $L_a > 24$ mm and $L_k > 28$ are not satisfied, cracks may occur in the glass stem 5.

SUMMARY OF THE INVENTION

Accordingly, an object of this invention is to improve the vibration resistance of the electrodes in a discharge tube, to improve the heat resistance of a discharge tube, and to improve the positional accuracy of the light emission point.

The foregoing object of the invention has been achieved by the provision of a discharge tube comprising: a sealed envelope filled with a gas; an anode, a cathode and a shielding electrode built in the sealed envelope; and electrode holding pins which penetrate a button stem of glass of the sealed envelope and hold those electrodes; in which, according to the invention, at least eight electrode holding pins penetrate the button stem in such a manner that the pins are arranged at predetermined intervals on a circle coaxial with the button stem, and of the at least eight electrode holding pins, at least three hold the cathode, at least three hold the shielding electrode, and at least two hold the anode.

In the discharge tube of the invention, the shielding electrode which has the electron converging part and shields the anode and the cathode is supported by at least three electrode holding pins, the anode is supported by at least two electrode holding pins, and the cathode is supported by at least three pins. Hence, those electrodes are positively held, and the conduction of heat from the pins is improved.

DETAILED DESCRIPTION OF THE PREFERRED EMBODIMENTS

A first embodiment of this invention will be described with reference to FIGS. 1(*a*) through 1(*c*).

Figure 1A:
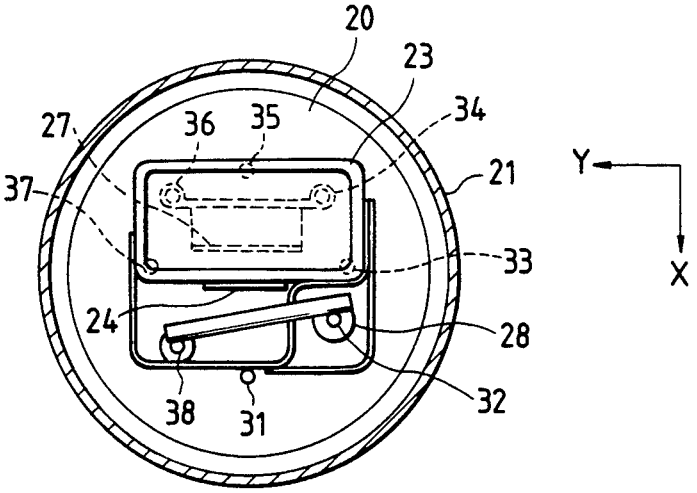
FIGS. 1(*a*) through 1(*c*) are a plan view, front view and side view showing a first example of a discharge tube according to this invention, respectively.
Figure 1B:
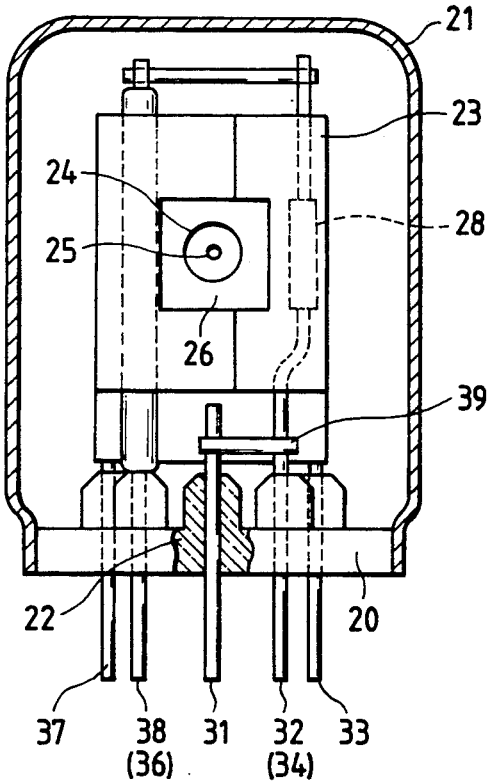
Figure 1C:
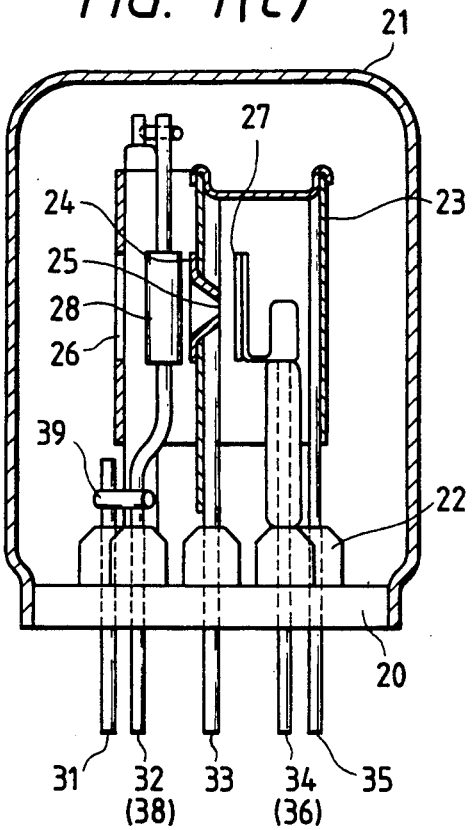

In FIGS. 1(*a*) through 1(*c*), reference numeral 20 designates a disk-shaped button stem of hard glass; and 21, a sealed envelope of transparent glass.

The button stem 20 has a plurality of relatively thick protrusions 22 (eight protrusions in the embodiment) arranged at predetermined intervals on a circle coaxial with the base of the button stem 20. The protrusions 22 are penetrated vertically by eight electrode holding pins 31 through 38, respectively. Those pins 31 through 38, arranged counterclockwise as shown in FIG. 1(*a*), will be referred to as first through eighth pins, respectively. Further in FIG. 1, reference numeral 23 designates a shielding electrode made of nickel or iron or its alloy; 24, an electrode made of molybdenum, tungsten, tantalum, or titanium or its alloy, the electrode 24 having an electron converging part 25 made up of a small hole; and 26, a light transmission window.

Holding of the shielding electrode 23

Figure 2A:
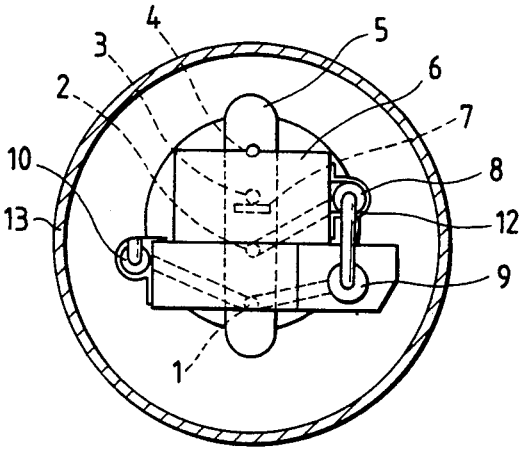
FIG. 2(a) PRIOR ART
FIGS. 2 (*a*) through 2(*c*) are a plan view, front view and side view showing a conventional discharge tube, respectively.
Figure 2B:
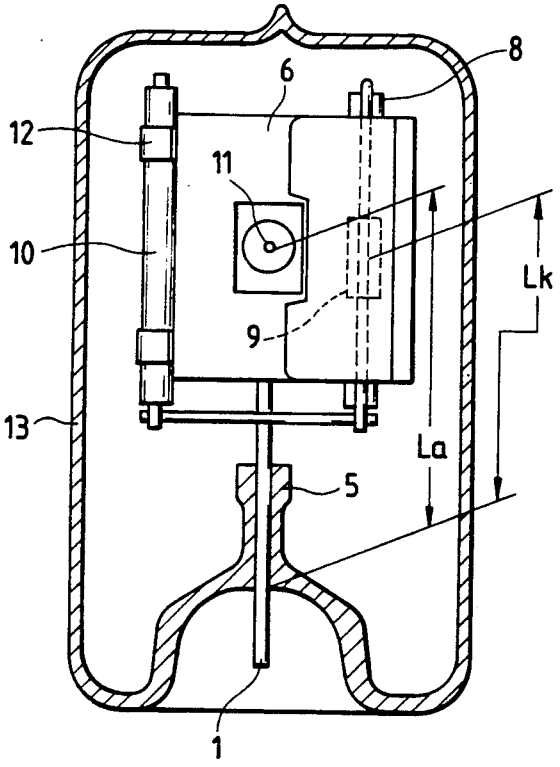
FIG. 2(b) PRIOR ART
Figure 2C:
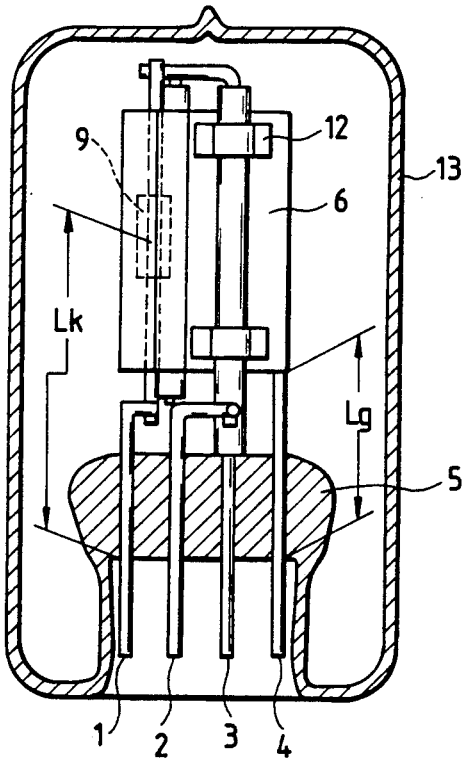
FIG. 2(c) PRIOR ART

The third pin 33 and the seventh pin 37 hold both ends of the shielding electrode 23, which are on both sides of the electron converging part 25 (in the Y-axis direction), and the fifth pin 35 holds one end of the shielding electrode 23 in the X-axis direction. The first pin may be used to hold the shielding electrode 23 when it is not used for other purposes. At any rate, the shielding electrode 23 is supported by at least three pins (33, 35 and 37). Heretofore, as shown in FIG. 2, only one pin 4 holds the shielding electrode 4 directly, and the others support it through the ceramic pipes 8 and 10. And there is a gap between the pins and the ceramic pipes. Hence, the conventional discharge tube is low in vibration resistance. On the other hand, as is apparent from the above description, the discharge tube according to the invention is sufficiently high in vibration resistance.

Holding of the anode 27

The fourth pin 34 and the sixth pin 36 support both ends of the anode 27 which is one of the heat generating sources. Since the anode is held by at least two pins, the fourth and sixth pins 34 and 36, thermal stress is distributed to those pins. Hence, if $0.8<d<1.2$ mm, the cracking of the button stem 20 is prevented in the range of $L_a>15$ mm.

Holding of the cathode 28

The cathode 28 is also one of the heat generating sources. The cathode 28 is called "hot-cathode", requiring a predetermined quantity of heat for emission of electrons. Therefore, if the heat radiation efficiency is too high, there occurs shortage of the quantity of heat, as a result of which the cathode will operate unstably. Heretofore, a large quantity of heat is transmitted to the electrode holding pin, thus often cracking the stem. As was described before, heretofore with $0.8>d>1.2$ mm, the relation $L_k>28$ mm is required to be met. On the other hand, in the embodiment of the invention, the first and second pins 31 and 32 are connected with a bridging pin 39 which is larger in diameter than them (31 and 32), for distribution of the thermal stress. The cathode 28 is supported additionally by the eighth pin 38. Since the cathode 28 is held by those three pins, the cracking of the button stem 20 is prevented in the range of $L_k>18$ mm.

Figure 3A:
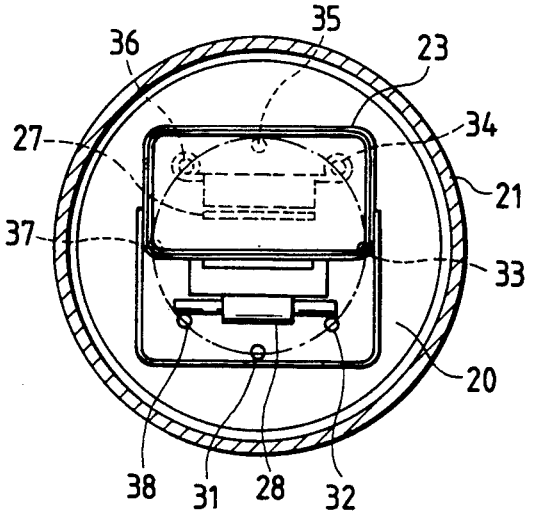
FIGS. 3(*a*) through 3(*c*) are a plan view, front view and side view showing a second example of the discharge tube according to the invention, respectively.
Figure 3B:
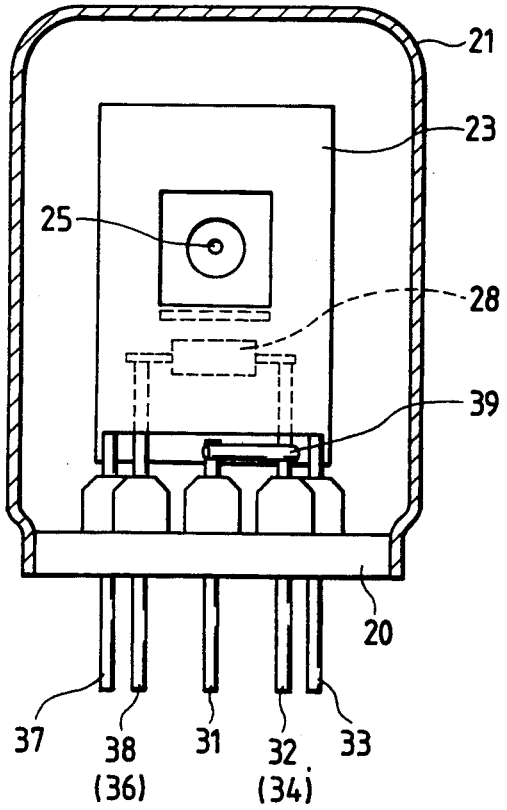
Figure 3C:
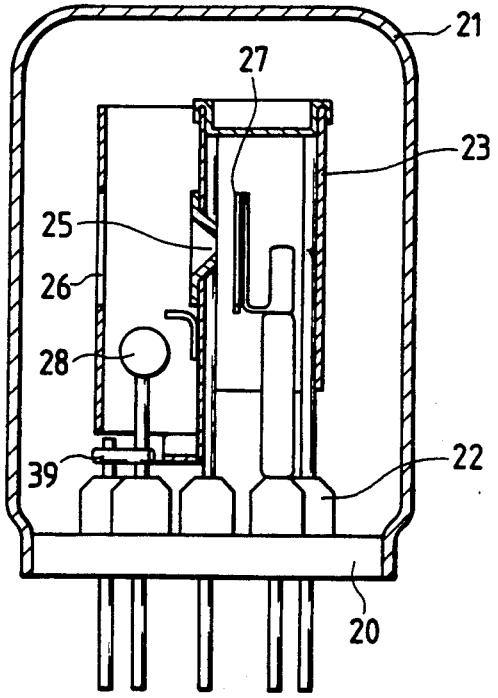

A second embodiment of the invention is as shown in FIGS. 3(*a*) through 3(*c*), where the cathode 28 is arranged below the electron converging part 25. In this figure, the parts having the corresponding parts in FIG. 1 are given the same reference numerals, and explanation for those parts are omitted here.

The present invention offers the following advantages:

(1) The heat radiation through the electrode holding pins is remarkably improved, which permits miniaturization of the lamp.

For instance, the limit value of the tube wall load ((quantity of input heat W watt)/(lamp outer surface area S $cm^2$)) of the lamp shown in FIG. 1 is improved as indicated in the following table, when compared with that of the conventional lamp shown in FIG. 2. This will allow miniaturization of the lamp.

| | S ($cm^2$) | W limit (watt) | W/S (watt/$cm^2$) |
|---|---|---|---|
| Prior art (FIG. 2) | 79.2 | 30 | 0.378 |
| Invention (FIG. 1) | 56.5 | 27 | 0.478 |

The limit value of the input heat quantity W is defined as a value at which the rate of stem crack occurrence after 1,000 hours of operation reaches 30% (the button stem is of hard glass, the pin diameter is $1.0\pm0.2$ mm, and the number of pins is eight). As described above, the eight pins are used as follows: three for the shielding electrode; two for the anode, and three for the cathode. And it is required that $L_g>7$ mm, $L_a>15$ mm, and $L_k>18$ mm.

(2) The electrodes are greatly improved in positional accuracy. Heretofore, positioning of the light emission point is performed in the electrode assembling process. Since the electrode holding pins are arranged in a line, in welding the shielding electrode 6, no pin is available to support the electron converging part 11 in the directions of X-, Y- and Z-axes. Accordingly, after the electrode is held with the fourth pin, the electron converging part 11 is visually positioned in the X-axis direction and then positioned and corrected in the Y-axis direction by using a microscope. However, the position cannot be corrected in the Z-axis direction. On the other hand, in the discharge tube of the invention, use is made of two pins arranged symmetrical with respect to the center of the button stem 20, and a U-shaped plate member to which the electron converging part 25 has been fixed in advance is prepared. The plate member is then mounted on the two pins, so that the centering in the X-axis direction is achieved. Thereafter, in the welding process, a microscope is utilized to achieve the positioning in the Y-axis direction and in the Z-axis direction more readily than in the prior art.

The light emission point may be shifted from the center of the button stem 20 in the X-axis direction by shifting the positions of the stem pins or by using an odd number of pins.

We claim:

1. A discharge tube comprising: a sealed envelope filled with a gas; an anode, a cathode and a shielding electrode built in said sealed envelope; and electrode pins for holding said electrodes, wherein at least three of said electrode holding pins penetrating a stem formed in the bottom of said sealed envelope, are used for holding said cathode, and two of said at least three electrode holding pins for holding said cathode are connected with a bridging pin, wherein said bridging pin diverts thermal stress from the two electrode holding pins connected thereto.

2. A discharge tube as claimed in claim 1, wherein at least eight electrode holding pins penetrate a button stem of glass so as to be arranged at predetermined intervals on a circle coaxial with said button stem; and of said at least eight electrode holding pins, at least three hold said shielding electrode, and at least two hold said anode.

3. A discharge tube as claimed in claim 2, wherein said shielding electrode has an electron converging part, and, of said at least three electrode holding pins for holding said shielding electrode, two are used to hold both side portions of said electrode converging part.

4. A discharge tube comprising:

a sealed envelope filled with a gas;

an anode, a cathode and a shielding electrode built in said sealed envelope; and at least eight electrode holding pins, three for holding said cathode, two for holding said anode and three for holding said shielding electrode;

wherein said shielding electrode surrounds said anode and has a hole therein constituting an electron converging part which is supported on either side by two of said three electrode holding pins which hold said shielding electrode.

5. The discharge tube of claim 4, wherein said electrode holding pins penetrate a button stem formed in the bottom of said sealed envelope so as to be arranged at predetermined intervals on a circle coaxial with said button stem.

* * * * *